United States Patent [19]

Kida

[11] Patent Number: 4,823,695

[45] Date of Patent: Apr. 25, 1989

[54] SHEET TURN-OVER APPARATUS FOR SHEET-FED ROTARY PRINTING PRESS

[75] Inventor: Kenji Kida, Ibaraki, Japan

[73] Assignee: Komori Printing Machinery Co., Ltd., Tokyo, Japan

[21] Appl. No.: 119,735

[22] Filed: Nov. 12, 1987

[30] Foreign Application Priority Data

May 20, 1986 [JP] Japan ..... 61-113688

[51] Int. Cl.[4] ..... B41F 5/02

[52] U.S. Cl. ..... 101/230

[58] Field of Search ..... 101/230, 183, 410, 409; 271/82, 277

[56] References Cited

U.S. PATENT DOCUMENTS 3,796,154 3/1974 Weisgerber ..... 101/230 X 4,700,626 10/1987 Iwamoto et al. ..... 101/230

FOREIGN PATENT DOCUMENTS 2122175 1/1984 United Kingdom ..... 101/409

*Primary Examiner*—Clifford D. Crowder

*Attorney, Agent, or Firm*—Perman & Green

[57] ABSTRACT

In a sheet turn-over apparatus for a sheet-fed rotary printing press, the right cams are a turn-over cam for gripper units A and opening/closing cams for gripper units B, while the left cams are a turn-over cam for gripper units B and opening/closing cams for gripper units A. The cams cooperate with the corresponding torsion bars arranged at the pivotal centers of cam levers to turn over and open/close the gripper units A and B. The cams are fixed at predetermined positions of frames and need not be shifted in the single side printing and double side printing. The gripper opening/closing cams need not be shifted in the non-turn-over and turn-over modes.

5 Claims, 12 Drawing Sheets

SHEET TURN-OVER APPARATUS FOR SHEET-FED ROTARY PRINTING PRESS

BACKGROUND OF THE INVENTION

The present invention relates to a sheet turn-over apparatus attached to a sheet-fed rotary printing press to turn over a sheet having a printed upper surface so as to print an image on the lower surface of the sheet.

A sheet-fed rotary printing press for performing single side printing and double side printing is commercially available due to a variety of printing modes. A sheet turn-over apparatus is attached to the sheet-fed rotary printing press to grip the trailing edge of the sheet having a printed upper surface and turn over the sheet in double side printing.

FIG. 13 shows a cylinder layout for explaining double side printing in a three-cylinder printing press including a transfer cylinder, a turn-over cylinder, and a double-diameter cylinder, all of which constitute a turn-over mechanism. The construction and double side printing of the printing press will be described with reference to FIG. 13. An impression cylinder 5 having gripper units 4 each comprising a gripper 2 and a gripper pad 3 is located obliquely below a blanket cylinder 1 which is located below a plate cylinder (not shown) and is in rolling contact therewith. A blanket cylinder 6 held in rolling contact with a plate cylinder and an impression cylinder 10 having gripper units 9 each comprising a gripper 7 and a gripper pad 8 and held in rolling contact with the blanket cylinder 6 are arranged in the downstream printing unit. A turn-over cylinder assembly consisting of a transfer cylinder 11, a double-diameter cylinder 12, and a turn-over cylinder, all of which are held in rolling contact with each other, is arranged between the impression cylinders 5 and 10. Of these cylinders for turn-over operation, the transfer cylinder 11 comprises gripper units 16 each comprising a gripper 14 and a gripper pad 15 in the axial gap on the outer surface. The double-diameter cylinder 12 has a diameter twice that of the transfer cylinder 11. Gripper units 19 and 20 each comprising a gripper 17 and a gripper pad 18 are arranged in the gaps of the outer surface at equal angular intervals. Two sets of suction heads 21 and 22 are axially arranged at forward positions (with respect to the rotational direction) spaced by predetermined angular intervals from the gripper units 19 and 20, respectively. More specifically, a plurality of suction heads 21 (or 22) are axially arranged in the outer surface of the cylinder 12 and are circumferentially movable, thereby adjusting the circumferential phase of the gripper units 19 (or 20). Gripper units (A) 25 each comprising a gripper 23 and a gripper pad 24 and gripper units (B) 28 each comprising a gripper 26 and a gripper pad 27 are circumferentially adjacent with each other and arranged in axial gaps, respectively. The cylinders 1, 5, 11, 12, 13, 10, and 6 are coupled by gears and are rotated in directions indicated by arrows.

With the above arrangement, in double side printing, the double-diameter cylinder 12 is rotated while the suction heads 21 and 22 are fixed and the phases of the gripper units 19 and 20 for the suction heads 21 and 22 are adjusted according to the paper size. Thereafter, all the cylinders are rotated in the directions indicated by the arrows, and a sheet 30 is gripped by the gripper units 4 of the impression cylinder 5. When the sheet 30 passes between the blanket cylinder 1 and the impression cylinder 5, an image is printed on the upper surface of the sheet 30 by the blanket cylinder 1. The sheet 30 is then regripped from the gripper units 4 of the impression cylinder 5 to the gripper units 16 of the transfer cylinder 11 and is conveyed by the transfer cylinder 11. The sheet 30 is regripped from the gripper units 16 of the transfer cylinder 11 to the gripper units 19 (or 20) of the double-diameter cylinder 12 and is conveyed while being chucked by the suction heads 21 (or 22). When the sheet 30 is wound around the double-diameter cylinder 12, and the trailing edge of the sheet reaches a point of contact between the cylinders 12 and 13, the suction heads 21 (or 22) oppose the gripper units (B) 28, and suction air is removed from the suction heads 21 (or 22). In this state, the gripper units (B) 28 are closed and the trailing edge of the sheet is released from the suction heads 21 (or 22) and is gripped by the gripper units (B) 28. When the sheet is directed toward the impression cylinder 10 while being gripped by the gripper units (B) 28, the direction of the gripper units (B) 28 is opposite to that of the gripper units 9, and transfer of the sheet from the gripper units (B) 28 to the gripper units 9 cannot be performed. The sheet 30 is regripped by the gripper units (A) 25 having a direction opposite to that of the gripper units (B) 28 and is conveyed by the gripper units (A) 25. In this manner, the sheet 30 which has turned over is regripped by the gripper units 9 of the impression cylinder 10. The sheet 30 passes between the blanket cylinder 6 and the impression cylinder 10. In this case, the lower surface of the sheet is brought into contact with the blanket cylinder 6, so that an image is transferred from the blanket cylinder 6 to the lower surface of the sheet, thereby completing double side printing.

When printing is started after the phase of the upstream cylinders including the double-diameter cylinder 12 is shifted with respect to the turn-over cylinder 13 and the gripper units 19 are set at positions corresponding to that of the gripper units (A) 25, the sheet 30 is not turned over and single side printing is performed. In this case, the gripper units (B) 28 are kept inoperative.

In the printing press operated as described above, during sheet turn-over operation in double side printing, the trailing edge of the sheet must be regripped from the gripper units (B) 28 to the gripper units (A) 25. In this case, the gripper units (A) 25 and (B) 28 whose gripper tips are directed outward must be turned over so as to regripper the sheet to the gripper units 19 and 9. A conventional sheet turn-over apparatus of this type includes a gripper opening/closing mechanism and a turn-over mechanism.

In an apparatus disclosed in Japanese Patent Publication No. 45-12929, gripper units corresponding to the gripper units (A) 25 and (B) 28 are fixed on pivot shafts, and pinions mounted on the pivot shafts are meshed with segment gears swung by a cam mechanism. A spring is hooked between the gripper unit and the cylinder to apply a pivotal force to the pivot shafts in a direction where a cam follower is urged against a cam surface. An additional cam mechanism is arranged to open/close the gripper unit at the turn-over position of the gripper unit.

With the above construction, when the gripper units come to the turn-over position, both the gripper units are pivoted through the segment gears and the pinions against the biasing force of the spring by means of the cam mechanism. When the turn-over operation is completed, the additional cam mechanism is operated to open/close the gripper units, thereby regripping the trailing edge of the sheet from one group of gripper units to the other group of gripper units. When the next regripping is timed, the gripper units are returned to the initial position by the biasing force of the spring.

In an apparatus disclosed in Japanese Patent Publication No. 51-7409, a turn-over mechanism includes segment gears, pinion gears, and springs as in the above mechanism. However, a gripper opening/closing mechanism of this apparatus is different from that described above. More specifically, the gripper opening/closing cam is swung at a predetermined timing by an additional cam, and the corresponding cam follower is reciprocally moved. The spring for closing the gripper unit is hooked between the free end portions of the gripper and the gripper pad.

In the conventional turn-over apparatuses having the constructions described above, a rotational force generated by a biasing force of the spring always acts on the pivot shafts. A large load acts on the teeth of the pinion fixed on the pivot shaft, and the teeth are easily worn out. In addition, since the gripper return spring is mounted on the pivot shaft, and a chain is connected to one end of the spring and is wound around the pivot shaft. The chain may be broken by the impact load of the cam. Furthermore, the gripper opening/closing cam and the gripper turn-over cam must be shifted when printing is switched between single side printing and double side printing. As a result, the construction and operations are complicated. In the apparatus disclosed in Japanese Patent Publication No. 51-7409, the gripper opening/closing cam is pivoted at a predetermined timing, and an excess load acts on the cam followers. As a result, the cam follower tends to be worn out. In addition, the biasing force of the gripper return spring always acts on the gripper pad shaft, and this shaft tends to be worn out.

SUMMARY OF THE INVENTION

It is an object of the present invention to provide a sheet turn-over apparatus for a sheet-fed rotary printing press, in which durability of its mechanism can be improved and the construction of the mechanism can be simplified.

It is another object of the present invention to provide a sheet turn-over apparatus for a sheet-fed rotary printing press, in which printing operations in single side printing and double side printing can be simplified.

It is still another object of the present invention to provide a low-cost sheet turn-over apparatus for a sheet-fed rotary printing press, in which symmetrical members can be used to reduce the number of different components.

In order to achieve the above objects of the present invention, there is provided a sheet turn-over apparatus for a sheet-fed rotary printing press including a turn-over cylinder provided with first gripper units for receiving a sheet from grippers of an upstream cylinder and gripping a trailing edge of the sheet and second gripper units for gripping the trailing edge of the sheet released and turned over from the first gripper units and causing grippers of a downstream cylinder to grip the trailing edge of the sheet, the first and second gripper units being adjacent to each other on an outer surface of the turn-over cylinder, comprising: right and left frames; a turn-over cam for the second gripper units, and first and second opening/closing cams for the first gripper units, all of which are fixed to one of the frames; a turn-over cam for the first gripper units and third and fourth opening/closing cams for the second gripper units, all of which are fixed to the other frame; first and second hollow cam lever shafts having different circumferential phases; a first cam lever fixed to one end of the first hollow cam lever shaft and a second cam lever fixed to the other end of the second hollow cam lever shaft, the first cam lever being provided with a segment gear at one end thereof and a first cam follower at the other end thereof, the second cam lever being provided with a segment gear at one end thereof and a second cam follower at the other end thereof, the first cam follower being in contact with the turn-over cam for the second gripper units, and the second cam follower being in contact with the turn-over cam for the first gripper units; a first gripper pad shaft for the first gripper units and a second gripper pad shaft for the second gripper units, the first and second gripper pad shafts extending in an axial direction of the turn-over cylinder; a first gripper shaft for the first gripper units and a second gripper shaft for the second gripper units, the first and second gripper shafts being hollow, adjacent to the first and second gripper pad shafts, respectively, and extending along the axial direction of the turn-over cylinder; a third cam lever fixed to one end of the first gripper pad shaft and a fourth cam lever fixed to the other end of the second gripper pad shaft, the third and fourth cam levers being provided with third and fourth cam followers, respectively, the third cam follower being in contact with the third and fourth opening/closing cams, and the fourth cam follower being in contact with the first and second opening/closing cams; first to fourth torsion bars extending through the first and second cam lever shafts and the first and second gripper shafts, respectively, one end of each of the first to fourth torsion bars being fixed to a corresponding one of the first and second cam lever shafts and the first and second gripper shafts, the first and second torsion bars being coupled to the first and second cam levers at the other end and one end of the first and second cam lever shafts, respectively, and the third and fourth torsion bars being coupled to the third and fourth cam levers, respectively, the first and second cam lever shafts being coupled to the first and second gripper pad shafts and the first and second gripper shafts through a gear mechanism.

According to the present invention, when the turn-over cylinder is rotated, and the cam followers are brought into contact with the cam surfaces of the gripper B (i.e., second gripper units) opening/closing cams, the gripper B turn-over cam, the gripper A turn-over cam, and the gripper A (i.e., first gripper units) opening/closing cams in the order named, the cam levers are pivoted by the spring forces of the torsion bars. When the gripper units B grip the trailing edge of the sheet and are turned over, the sheet is conveyed by the gripper units A.

BRIEF DESCRIPTION OF THE DRAWINGS

FIG. 2 is a partially cutaway plan view of internal structures at the center of both the end shafts of the turn-over shaft, showing the opening/closing cam torsion bars and the like;

DESCRIPTION OF THE PREFERRED EMBODIMENTS

Figure 1:
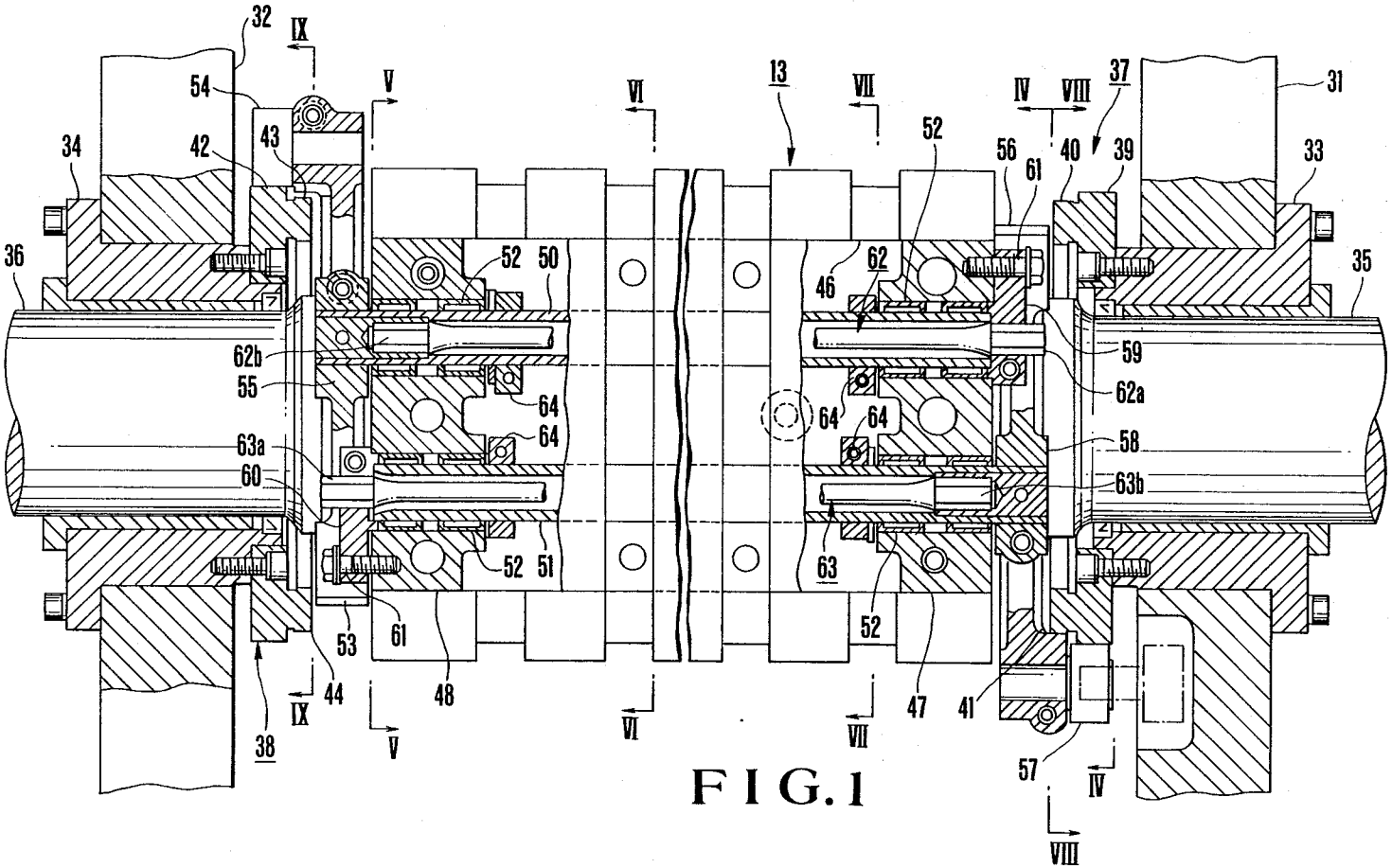
FIG. 1 is a partially cutaway plan view of internal structures at both end shafts of a turn-over cylinder, showing turn-over cam torsion bars and the like in a turn-over apparatus for a sheet-fed rotary printing press according to an embodiment of the present invention.

Referring to FIGS. 1 to 9, end shafts 35 and 36 of a turn-over cylinder 13 are supported by bearings 33 and 34 mounted in right and left frames 31 and 32, respectively. Right cams 37 and left cams 38 are fixed to the bearings 33 and 34 so as to oppose the end faces of the turn-over cylinder 13. The right cams 37 comprises a turn-over cam 39 for gripper units A, first and second opening/closing cams 40 and 41 for gripper units B. The turn-over cam 38 has an outer cam surface, the opening/closing cam 40 has an outer cam surface, and the opening/closing cam 41 has an inner cam surface. The shapes of the cams 39, 40 and 41 will be described later. The left cams 38 comprises a turn-over cam 42 for gripper units B and first and second opening/closing cams 43 and 44 for gripper units A. The turn-over cam 42 has an outer cam surface, the opening/closing cam 43 has outer and inner cam surfaces, and the opening/closing cam 44 has an outer cam surface. The shapes of the cams 42, 43, and 44 will be described later. Two gaps 45 and 46 which are 180° out of phase are formed in the turn-over cylinder 13 along the axial direction thereof. Bearing plates 47 and 48 are fixed to both ends of one gap 46 by a plurality of bolts 49 so as to close the gap 46. Two hollow cam lever shafts 50 and 51 having different circumferential phases are pivotally supported on the bearing plates 47 and 48 through roller bearings 52, respectively. A cam lever 55 is fixed to the right extended end of the cam lever shaft 50, while a cam lever 58 is fixed to the left extended end of the cam lever shaft 51. A segment gear 51 is fixed to one free end of the cam lever 55, and a cam follower 54 is supported by the other free end of the cam lever 55. A segment gear 56 is mounted on one free end of the cam lever 58 and a cam follower 57 is supported by the other free end of the cam lever 58. Bar holders 59 and 60 are fixed by bolts 61 so as to be adjusted at end faces of the bearing plates 47 and 48 at positions where the cam levers 55 and 58 of the cam lever shafts 50 and 51 are not mounted. Hexagonal heads 62*a* and 63*a* of torsion bars 62 and 63 extending through the inner holes of the cam lever shafts 50 and 51 are inserted into hexagonal holes formed in the bar holders 59 and 60, respectively. Hexagonal heads 62*b* and 63*b* of the torsion bars 62 and 63 are fixed by knock pins together with the cam levers 55 and 58 in the hexagonal holes of the bushings in the cam lever shafts 50 and 51. Therefore, the cam levers 55 and 58 are pivoted by an external force and spring forces can be accumulated in the torsion bars 62 and 63. The cam followers 54 and 57 contact the cam surfaces of the turn-over cams 42 and 39, respectively. These cam followers 54 and 57 are brought into tight contact with the cam surfaces by the pivotal forces applied from the torsion bars 62 and 63 to the cam levers 55 and 58. The contact forces can be adjusted by pivotal movement of the bar holders 59 and 60. Reference numerals 64 denote collars fixed at both ends of the cam lever shafts 50 and 51 to prevent axial movement of the cam lever shafts 50 and 51.

Figure 2:
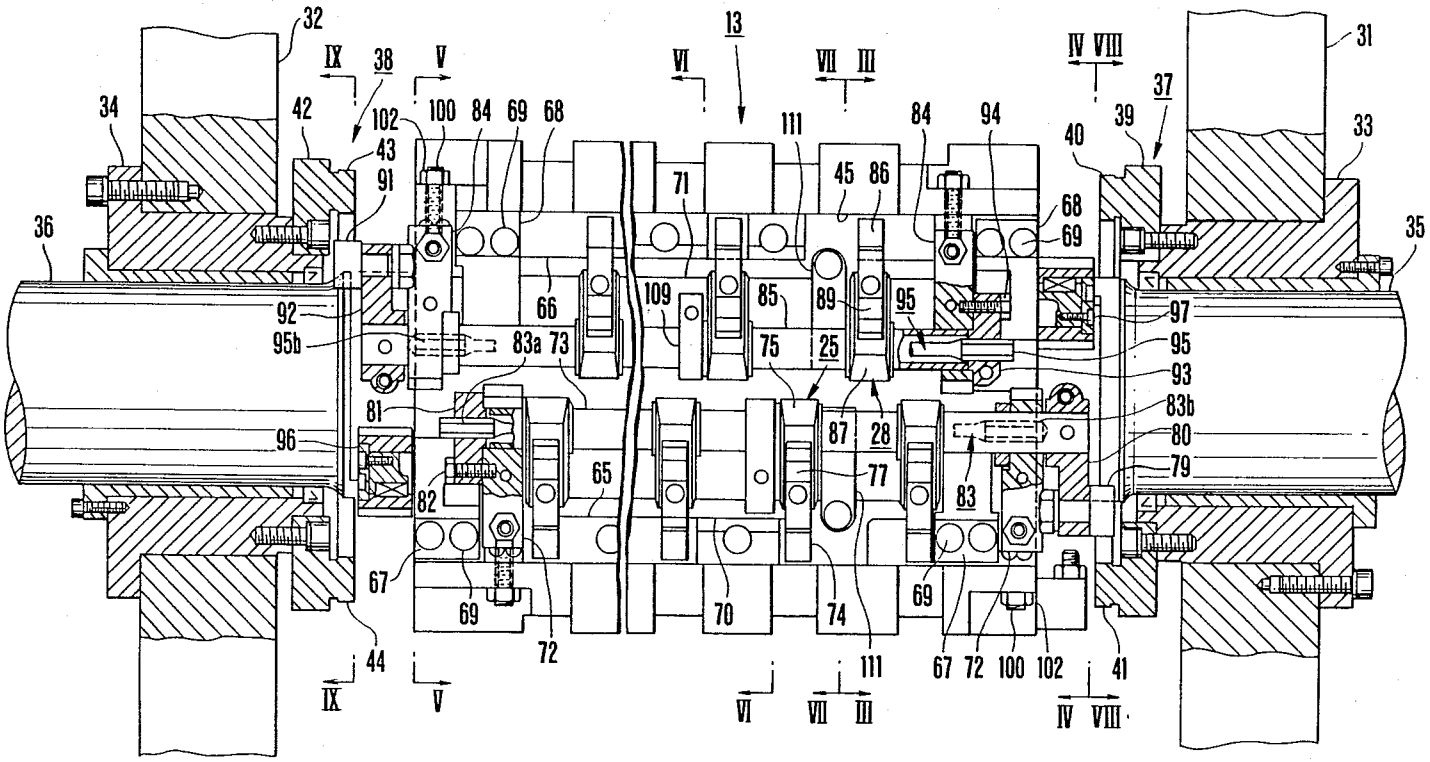
Figure 3:
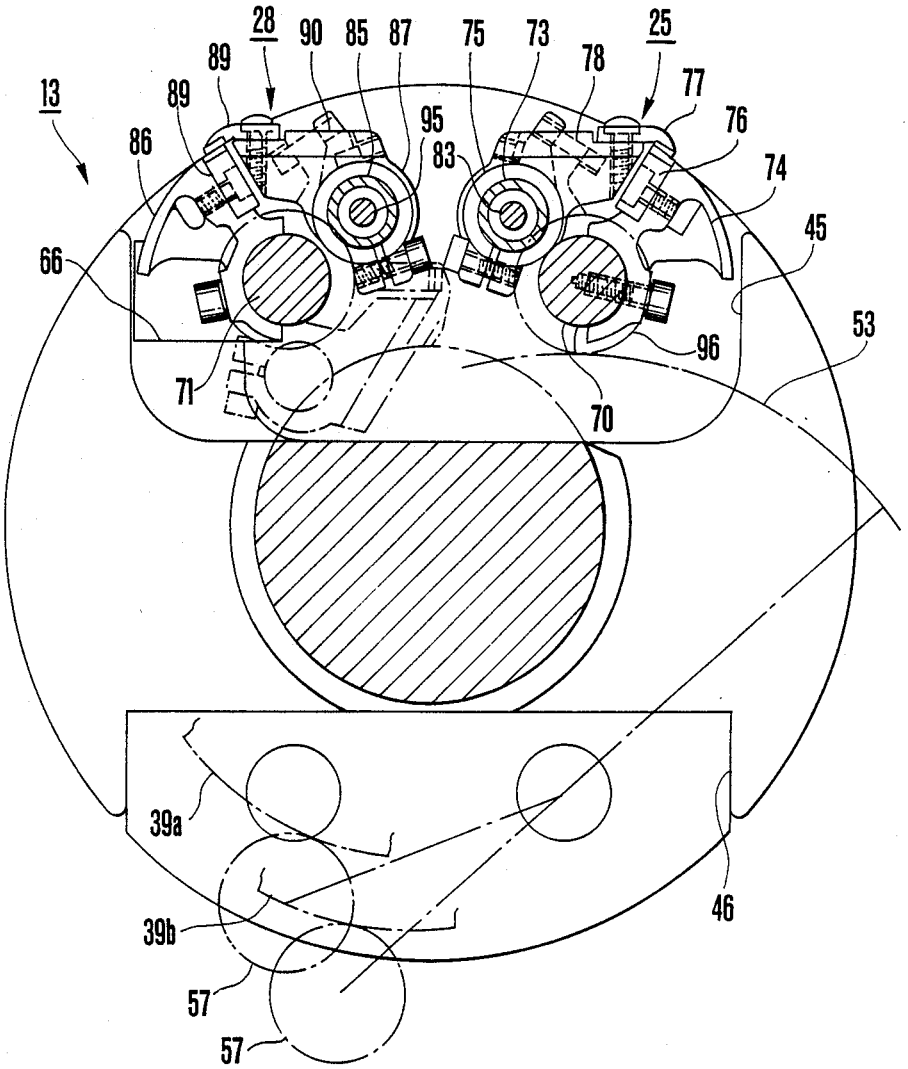
FIG. 3 is a sectional view of the turn-over apparatus along the line III—III of FIG. 2.
Figure 5:
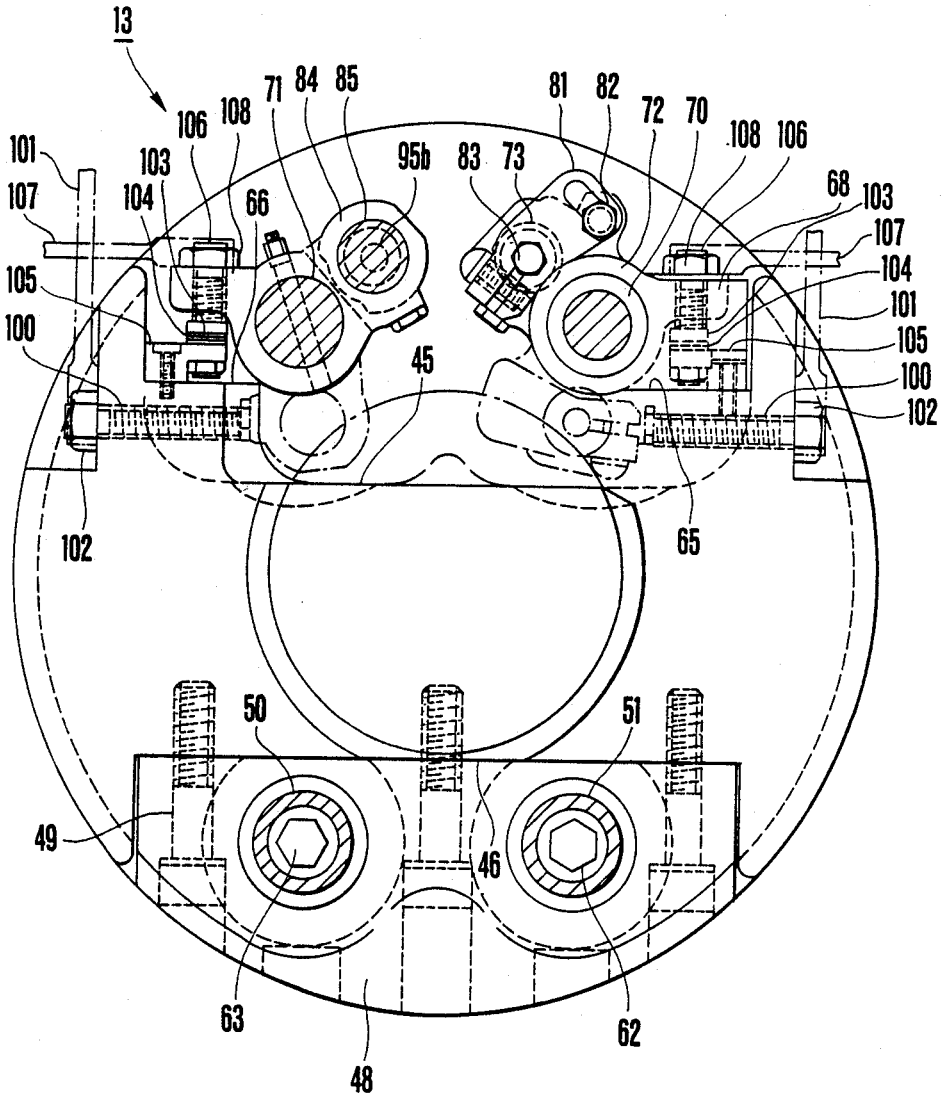
FIG. 5 is a sectional view of the turn-over apparatus along the line V—V of FIGS. 1 and 2.
Figure 6:
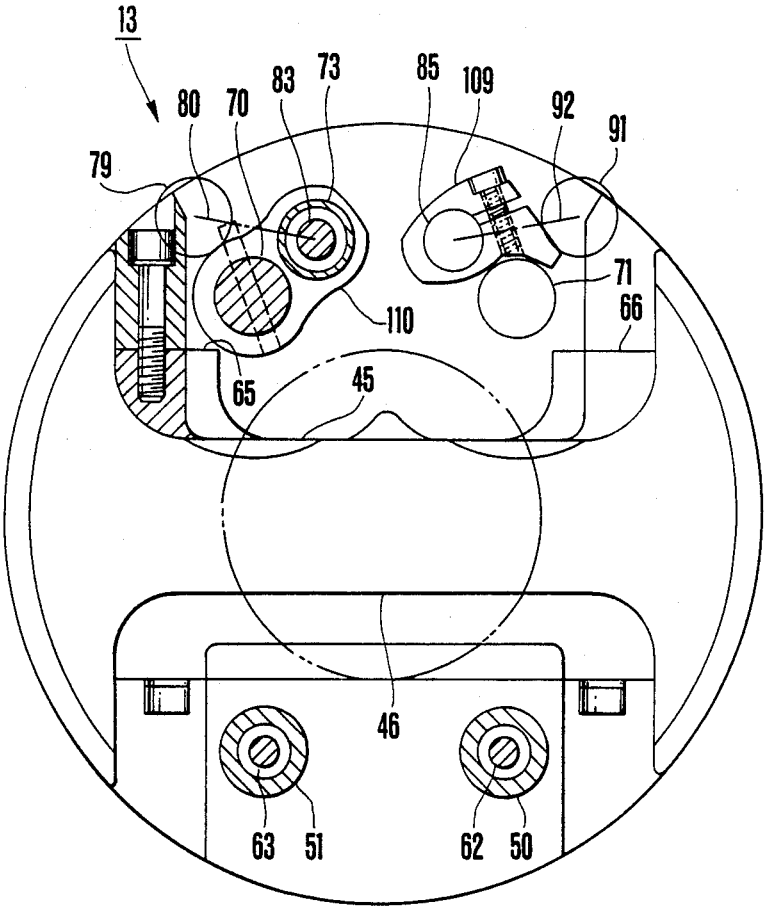
FIG. 6 is a sectional view of the turn-over apparatus along the line VI—VI of FIGS. 1 and 2.

Two axially elongated stationary seat members 65 and 66 are formed at both sides of the other gap 45 of the turn-over cylinder 13. A plurality of gripper pad bearings 67 and a plurality of gripper pad bearings 68 are fixed to the end portions and the intermediate portions of the stationary seat members 65 and 66 by bolts 69. A gripper pad shaft 70 for gripper units (A) extends by the overall length of the cylinder and is pivotally supported by the gripper pad bearings 67. A gripper pad shaft 71 (represented by the same reference numeral in FIGS. 10 and 11) for gripper units (B) extends by the overall length of the cylinder and is pivotally supported by the gripper pad bearings 68. Gripper shaft holders 72 are fixed to both ends of the gripper pad shaft 70 by knock pins, as shown in FIGS. 2 and 5. Both end portions of a hollow gripper shaft 73 are pivotally supported in the gripper shaft holders 72, respectively. A plurality of gripper units (A) 25 are supported by the gripper pad shaft 70 and the gripper shaft 73 along the axial direction. Each gripper unit (A) 25 comprises a gripper pad holder 74 fixed on the gripper pad shaft 70, a split gripper holder 75 fixed on the gripper shaft 73 so as to have the same axial phase as that of the gripper pad holder 74. A gripper pad 76 is fixed on the corresponding gripper pad holder 74. Each gripper 77 is mounted on the corresponding gripper holder 75 through a corresponding contact pressure adjustment spring member 78 and is brought into contact with the corresponding gripper pad 76 or separated therefrom upon pivotal movement of the gripper holder 75. Opening/closing of the gripper 77 with respect to the gripper pad 76 is referred to as that of the gripper unit (A) 25. A cam lever 80 having a cam follower 79 at its free end is fixed to the right extended end of the gripper pad shaft 70. A bar holder 81 is fixed by a bolt 82 to the end face of the gripper shaft holder 72 at a position where the cam lever 80 is not arranged, while part of the boss is fitted to be pivotal in the inner hole of the gripper shaft holder 72. Reference numeral 83 denotes a torsion bar, a hexagonal head 83*a* of which is fitted in a hexagonal hole of the bar holder 81. The torsion bar 83 extends through the inner hole of the gripper shaft 73 and a hexagonal head 83*b* of the torsion bar 83 is fitted in a hexagonal hole formed in the solid portion of the gripper shaft 73. When the cam lever 80 is pivoted by an external force, a torsion spring force is accumulated by the torsion bar 83.

As shown in FIGS. 2 and 5, gripper shaft holders 84 are fixed at both ends of the gripper pad shaft 71 by knock pins. Both end portions of a hollow gripper shaft 85 are pivotally supported by the gripper shaft holders 84. A plurality of gripper units (B) 28 are supported by the gripper pad shaft 71 and the gripper shaft 85 along the axial direction. Each gripper unit (B) 28 comprises a gripper pad holder 86 fixed on the gripper pad shaft 71 and a gripper holder 87 fixed on the gripper shaft 85 so as to have the same axial phase as that of the gripper pad holder 86. Each gripper pad 88 is fixed on the corresponding gripper pad holder 86. Each gripper 89 is fixed on the corresponding gripper holder 87 through a corresponding contact pressure adjustment spring member 90 and is brought into contact with the corresponding gripper pad 88 or separated therefrom. Opening/closing of the gripper 89 with respect to the gripper pad 88 is referred to as opening/closing of the gripper unit (B) 28. A cam lever 92 having a cam follower 91 at its free end is fixed to the left extended end of the gripper pad shaft 71. A bar holder 93 is fixed on the end face of the gripper shaft holder 84 at a position where the cam lever 92 is not arranged. In this case, part of the boss is pivotally fitted in the inner hole of the gripper shaft holder 84. Reference numeral 95 denotes a torsion bar, a hexagonal head 95*a* of which is fitted in a hexagonal hole of the bar holder 93. The torsion bar 95 extends through the inner hole of the gripper shaft 85, and a hexagonal head 95*b* of the torsion bar 95 is fitted in a hexagonal hole formed in the solid portion of the gripper shaft 85. When the cam lever 92 is pivoted by an external force, a torsion spring force can be accumulated by the torsion bar 95.

Figure 8:
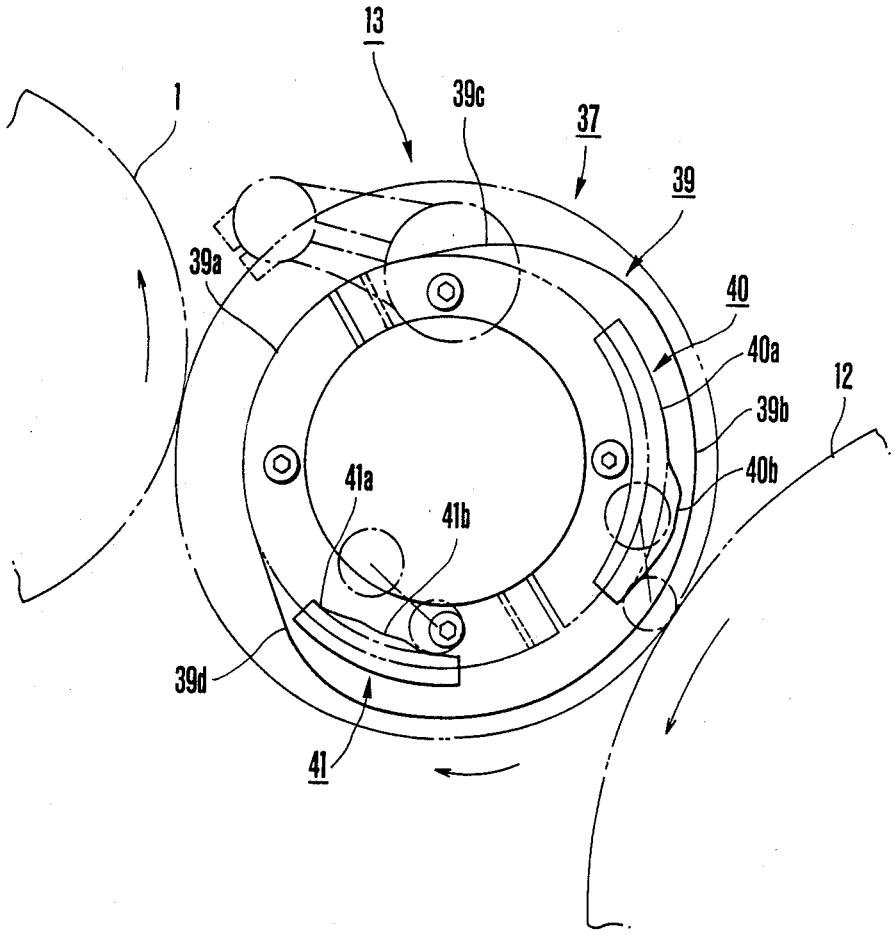
FIG. 8 is a sectional view of the turn-over apparatus along the line VIII—VIII of FIGS. 1 and 2.
Figure 9:
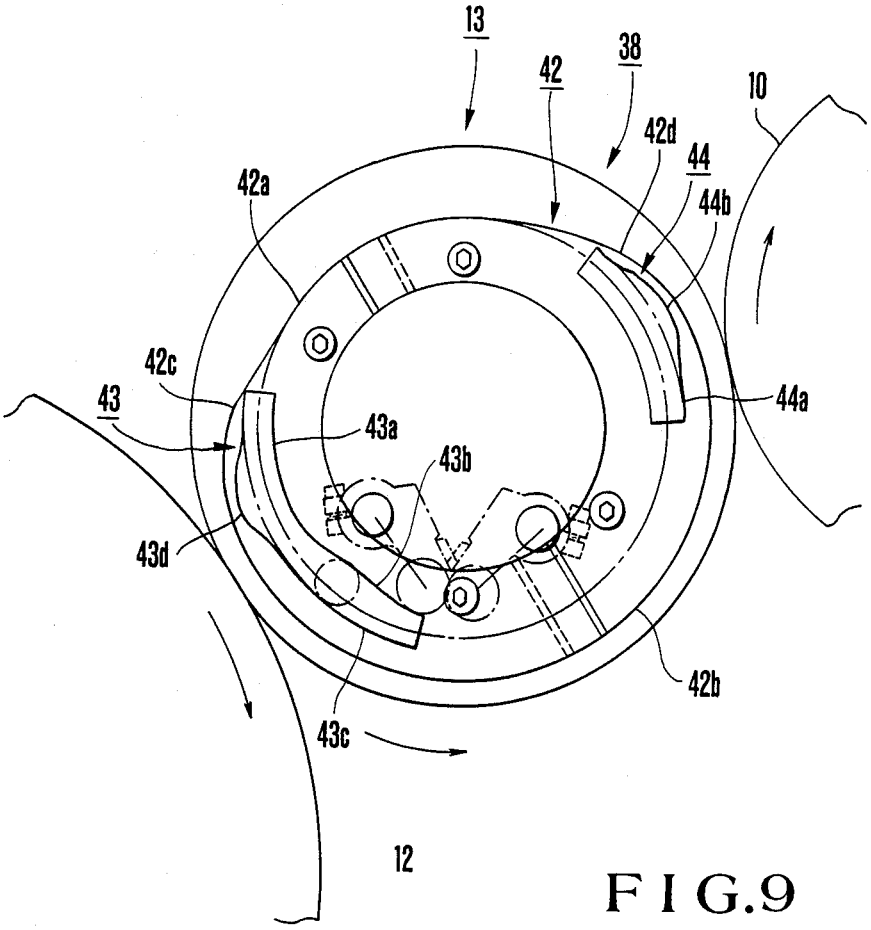
FIG. 9 is a sectional view of the turn-over apparatus along the line IX—XI of FIGS. 1 and 2.

A turn-over mechanism for turning over the gripper units (A) 25 and (B) 28 about the gripper pad shafts 70 and 71 and an opening/closing mechanism for opening/closing the grippers 77 and 89 about the gripper shafts 73 and 85 are provided to the gripper units (A) 25 and (B) 28. More specifically, pinions 96 and 97 meshed with the segment gears 53 and 56 are fixed to the left end of the gripper pad shaft 70 and the right end of the gripper pad shaft 71, respectively. The cam followers 54 and 57 are urged against the cam surfaces of the turn-over cams 42 and 39 by the spring forces of the torsion bars 62 and 63, respectively. As shown in FIG. 9, the turn-over cam 42 comprises a small-diameter portion 42*a*, a large-diameter portion 42*b*, and an ascending surface 42*c* in a rotational direction, and a descending surface 42*d* in the rotational direction. As shown in FIG. 8, the turn-over cam 39 comprises a small-diametr portion 39*a*, a large-diameter portion 39*b*, an ascending surface 39*c* in the rotational direction, and a descending surface 39*d* in the rotational direction. When the cam followers 54 and 57 are in rolling contact with the large-diameter portions 42*b* and 39*b*, the gripper units (B) 28 and (A) 25 are located at positions indicated by the solid lines in FIG. 3, respectively. When the turn-over cylinder 13 is rotated, and the cam followers 54 and 57 are moved downward along the descending surfaces 42*d* and 39*d*, the segment gears 53 and 56 are meshed with the pinions 96 and 97, respectively. The gripper units (B) 28 are turned over clockwise to the position indicated by the alternate long and short dashed line in FIG. 3. The gripper units (A) 25 are turned over counterclockwise and reach the position opposite to the gripper units (B) 28. Furthermore, when the cam followers 54 and 57 are moved upward along the ascending surfaces 42*c* and 39*c*, the gripper units (B) 29 and (A) 25 are pivoted in opposite directions and restore the initial positions indicated by the solid lines in FIG. 3.

Figure 12:
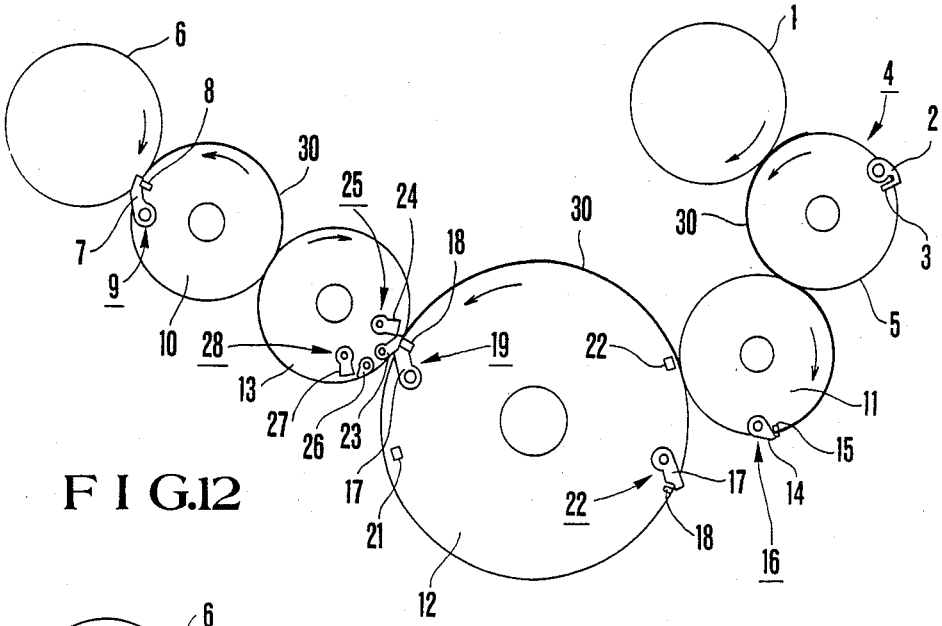
FIG. 12 is a view showing a cylinder layout of the printing press to explain single side printing.
Figure 13:
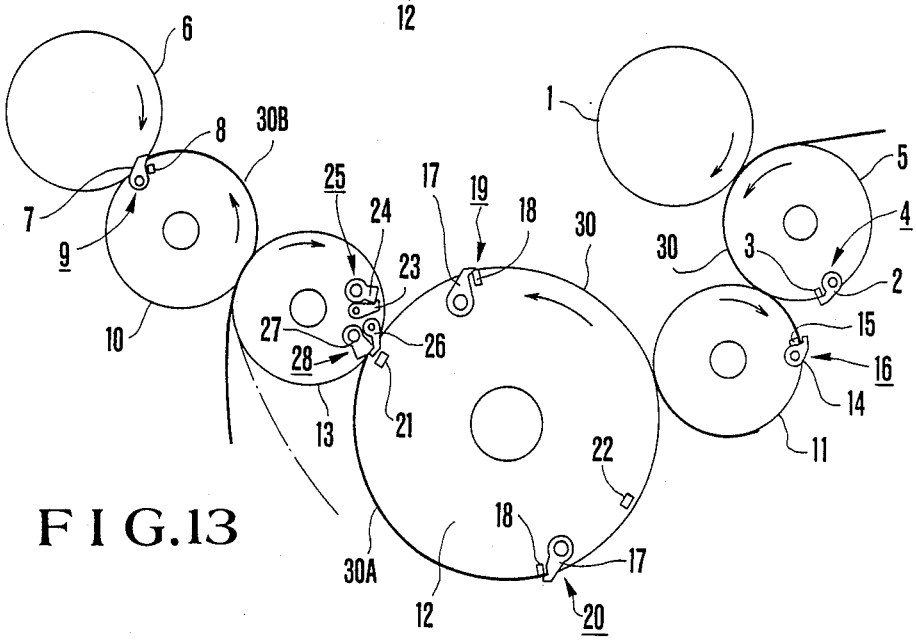
FIG. 13 is a view showing a cylinder layout of the printing press to explain double side printing.

The cam follower 79 is brought into rolling contact with the outer cam surface of the cam 40 and the inner cam surface of the cam 41 and is urged against the cam surface by the pivotal force acting on the cam lever 80 by a spring force of the torsion bar 83. The cam follower 91 is in contact with the outer and inner cam surfaces of the opening/closing cam 43 and the outer cam surface of the opening/closing cam 44 and is urged by the torsion bar 95. As shown in FIG. 8, the outer cam surface of the opening/closing cam 40 comprises a small-diameter portion 40*a*, a large-diameter portion 40*b*, and ascending and descending surfaces therebetween. The inner cam surface of the opening/closing cam 41 comprises a short small-diameter portion 41*a*, a small-diameter portion 41*b*, and ascending and descending surfaces therebetween. As shown in FIG. 9, the inner cam surface of the opening/closing cam 43 comprises a small-diameter portion 43*a*, a large-diameter portion 43*b*, and ascending and descending surfaces therebetween. The outer cam surface of the cam 43 comprises a small-diameter portion 43*c*, a large-diameter portion 43*d*, and ascending and descending surfaces therebetween. The outer cam surface of the opening/closing cam 44 comprises a small-diameter portion 44*a*, a large-diameter portion 44*b*, and ascending and descending surfaces therebetween. The cam surfaces have the shapes described above. In single side printing shown in FIG. 12, an apparatus (to be described later) is operated to render the turn-over cams 39 and 42 and the opening/closing cams 40 and 41 inoperative and the opening/closing cams 43 and 44 operative. As shown in FIG. 12, when the gripper units 19 oppose the gripper units 25, the cam follower 91 runs over the large-diameter portion 43*d* of the opening/closing cam 43, and therefore the gripper units 25 are opened and then closed so that the sheet is regripped by the gripper units 19. The cam follower 91 is moved upward along the ascending surface of the cam 43 against the spring force of the torsion bar 95. The cam follower 91 is moved downward along the descending surface by the spring force of the torsion bar 95. In single side printing, the inner cam surface of the cam 43 is not used. When the respective cylinders are rotated and the grippers 25 which actually grip the sheet oppose the gripper units 9 of the impression cylinder 10, the cam follower 91 runs over the large-diameter portion 44*b* of the opening/closing cam 44 and cooperates with the torsion bar 95 to open and close the gripper units 25 and cause the gripper units 9 to regrip the sheet. In double side printing, the cams 39, 40, 41, and 42 rendered inoperative in single side printing are rendered operative together with the cams 43 and 44. As shown in FIG. 13, when the suction heads 21 oppose the gripper units 28, the cam follower 79 runs over the large-diameter portion 40*b* of the opening/closing cam 40 and cooperates with the torsion bar 83 to open and close the gripper units 28, thereby causing the gripper units 28 to grip the trailing edge of the sheet fed from the suction heads 21. When the cylinders are further rotated, the cam followers 54 and 57 ascend along the ascending surfaces 42*c* and 39*c* of the turn-over cams 42 and 39. The cam levers 55 and 58 are pivoted against the spring forces of the torsion bars 62 and 63, respectively. The grippers 89 and 77 in gripper units 28 and 25 are pivoted about the gripper pad shafts 71 and 70 and come close to each other through the pinions 96 and 97. When the cylinders are further rotated, the cam followers 91 and 79 cooperate with the torsion bars 95 and 83 to run over the large-diameter portions 43*b* and 41*b* of the opening cams 43 and 41, respectively. The gripper units 28 and 25 are opened and closed at slightly different timings, so that the trailing edge of the sheet is released from the gripper units 28 and gripped by the gripper units 25. When the cylinders are further rotated, the cam followers 54 and 57 are moved downward along the descending surfaces 42*d* and 39*d* of the turn-over cams 42 and 39, and the gripper units 28 and 25 are turned in opposite directions to restore the initial states. When the cylinders are further rotated and the gripper units 25 oppose the gripper units 9, the gripper units 25 are opened and closed by the behavior of the cam 44 in the same manner as in single side printing. Therefore, the trailing edge of the sheet is regripped by the gripper units 9.

Figure 4:
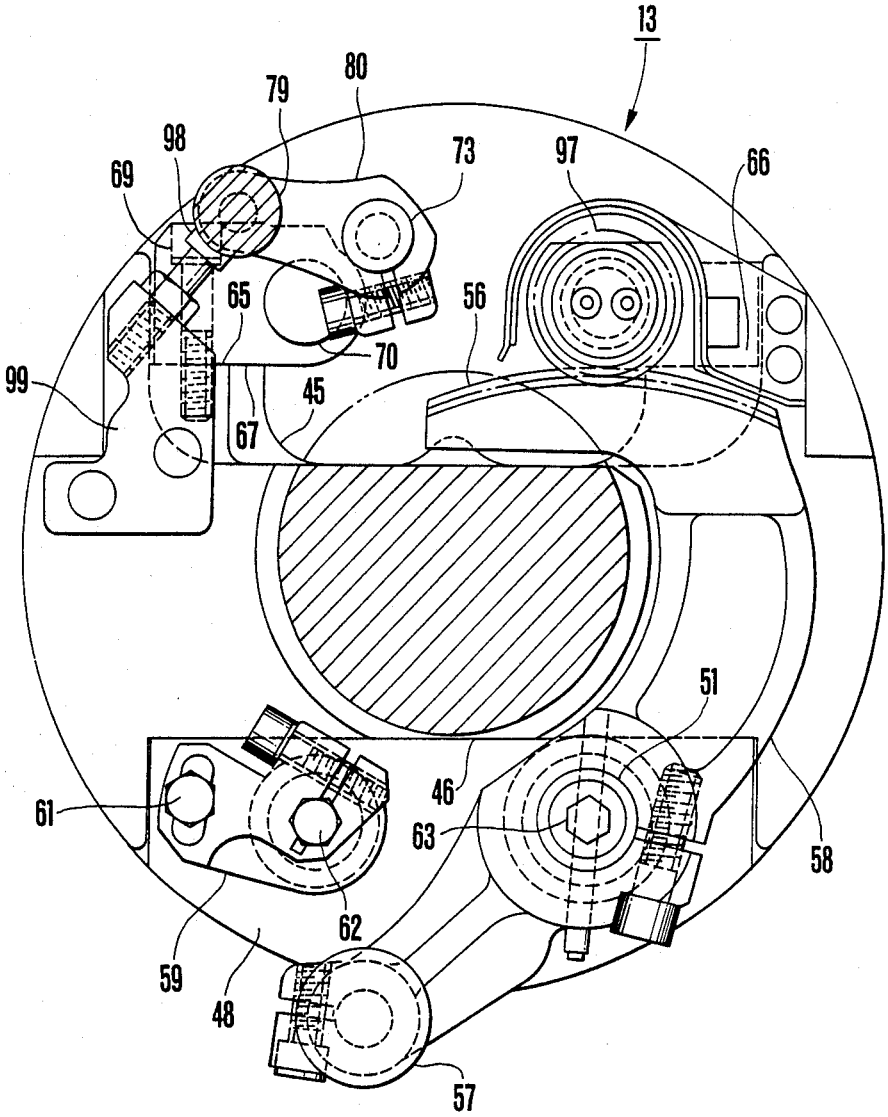
FIG. 4 is a sectional view of the turn-over apparatus along the line IV—IV of FIGS. 1 and 2.

Reference numeral 98 in FIG. 4 denotes a stopper reciprocally and threadably engaged in a stationary bracket 99 in correspondence with the cam lever 80. When the cam lever 80 is brought into contact with the stopper 98, the cam lever 80 is at the pivot end position. In single side printing, the cam follower 79 is separated from the cam surfaces of the opening/closing cams 40 and 41 to interrupt opening/closing of the gripper units 28. Reference numerals 100 in FIGS. 2 and 5 denote stoppers reciprocally and threadably engaged with the cylinder end portions corresponding to the gripper shaft holders 72 and 84. The gripper shaft holders 72 and 84 are brought into contact with the stoppers 100 at the pivot end positions, and the turn-over end positions of the gripper units 25 and 28 are limited. Reference numerals 101 denote tools for loosening nuts 102 to reciprocally move the stoppers 100. Reference numerals 103 in FIG. 5 denote stoppers supported by cylinder end face brackets 105 through a plurality of bevel springs 104 so as to correspond to the gripper shaft holders 72 and 84. Bolts 106 reciprocally and threadably engaged with the gripper shaft holders 72 and 84 are brought into contact with the stoppers 103 to limit the turn-over end position where the trailing edge of the sheet is regripped from the gripper units 28 to the gripper units 25. Reference numerals 107 denote tools for loosening nuts 108 to reciprocally move the bolts 106. Reference numerals 109 in FIG. 6 denote gripper opening/closing stoppers for the gripper shafts 73 and 85, disposed near the gripper pad shafts 70 and 71. The stoppers 109 are fixed by bolts at intermediate portions of the gripper shafts 73 and 85. Reference numeral 110 denotes stoppers fixed on the gripper pad shafts 70 and 71 to connect the intermediate portions of the gripper shafts 73 and 85 and the gripper pad shafts 70 and 71.

Figure 7A:
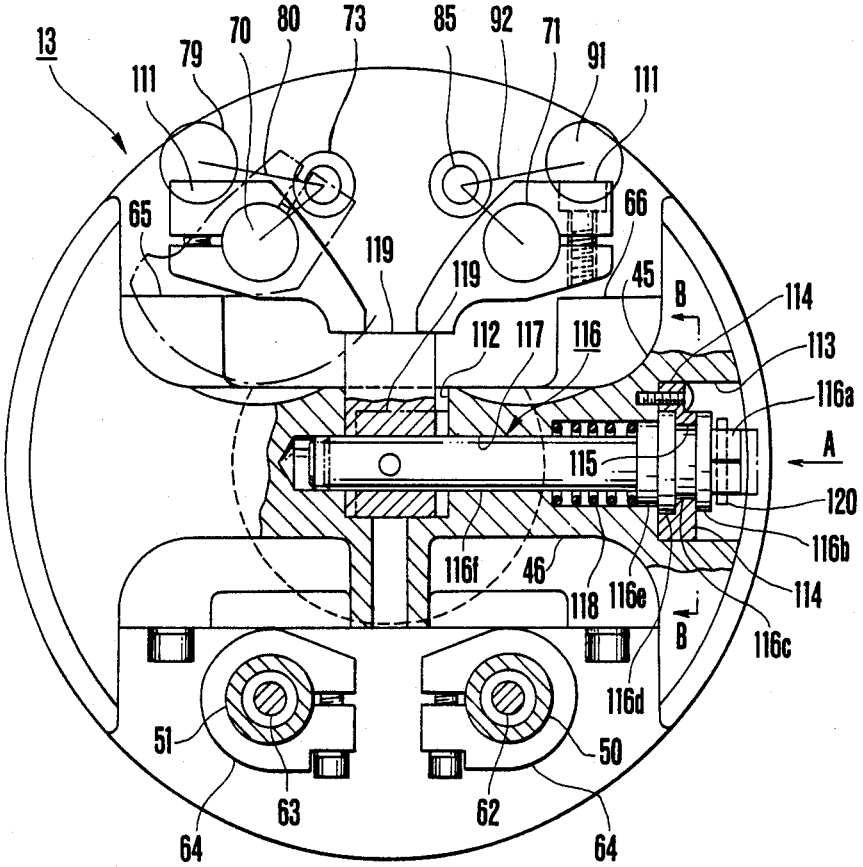
FIG. 7A is a sectional view of the turn-over apparatus along the line VII—VII of FIGS. 1 and 2.
Figure 7B:
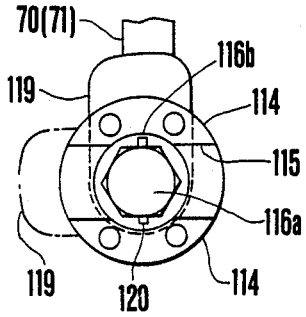
FIG. 7B is a sectional view of the structure along the line A of FIG. 7A.
Figure 7C:
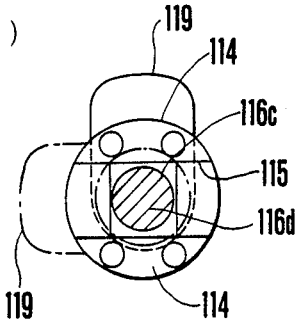
FIG. 7C is a sectional view of the structure along the line B—B of FIG. 7A.

A mechanism for interrupting the turn-over operation of the gripper units 25 and 28 in single side printing will be described with reference to FIGS. 2 and 7. Split stop levers 111 are fixed at the intermediate portions of the gripper pad shafts 70 and 71 for supporting the gripper units 25 and 28, respectively. Axially elongated stopper holes 112 are formed in the core of the cylinder so as to correspond to the stop levers 111. Recesses 113 are formed in the peripheral portion of the cylinder at positions corresponding to the stopper holes 112. A pair of crescent guides 114 having an L-shaped section are fixed by screws at the bottom of each recess 113. A guide groove 115 is formed between the upper and lower guides 114. Reference numeral 116 denotes a stop pin reciprocally fitted in a pin hole 117 formed to communicate with the recesses 113 and the stopper holes 112. The stop pin comprises a hexagonal head 116*a*, a round flange 116*b*, a circular portion 116*c*, a barrel-like flange 116*d* obtained by chamfering two surfaces of a cylindrical member, a circular spring seat 116*e*, and a bearing 116*f*. A compression coil spring 118 is disposed between the spring seat 116*e* and the spring hole bottom surface to bias the stop pin 116 toward the peripheral direction of the cylinder. A chamfered rectangular stopper 119 is fixed to the stop pin 116 in the stopper hole 112. The stop pin can be pivoted through 90° between upright and lying positions indicated by the solid lines of FIGS. 7B and 7C. A hexagonal hole of a tool is engaged with the hexagonal head 116*a* and the stop pin is urged against the biasing force of the compression coil spring 118 and is turned by the tool. When the stopper 119 is set in the upright position, the nonchamfered portion of the flange 116*d* abuts against the guides 114. The movement of the stop pin 116 in the peripheral direction of the cylinder is limited, and the stop pin 116 abuts against the guides 114 by the biasing force of the compression coil spring 118. In this state, when the stop pin 116 is urged and pivoted through 90°, the stopper 119 is set in the lying position and the chamfered portion of the flange 116*d* is engaged with the guide groove 115. The stopper 119 is biased by the compression coil spring 118 until the stopper 119 abuts against the wall surfaces of the stopper hole 112. Reference numerals 120 denote knock pins to be engaged with the grooves of the tool. With the above construction, when the stopper 119 is set in the upright position in single side printing, piotal movement of the stop lever 111 is limited. The cam followers 54 and 57 are separated from the cam surfaces of the turn-over cams 42 and 39 through the pinions 96 and 97, the segment gears 53 and 56, and the cam levers 55 and 58, thereby interrupting the turn-over operation.

Single side printing in the printing press having the construction described above will be described with reference to FIG. 12. When double side printing is switched to single side printing, the phases of the upstream cylinders including the double-diameter cylinder 12 are adjusted with respect to the turn-over cylinder 13 by an apparatus (not shown) so that a state of correspondence between the suction heads 21 and the gripper units 28, as shown in FIG. 13, is changed to a state of correspondence between the gripper units 19 and 25, as shown in FIG. 12. At the same time, the relative phases of the gripper units 19 and 20 and the suction heads 21 and 22 are adjusted. In addition, a position at which the sheet 30 is released from the gripper units 19 and 20 is adjusted. Thereafter, the stop pin 116 is pivoted in the upright position and pivotal movement of the stop lever 111 is inhibited. The turn-over operation between the gripper units 25 and 28 through the pinions 96 and 97, the segment gears 53 and 56, and the cam levers 55 and 58 is inhibited. At the same time, the stoppers 98 and 103 which are respectively shown in FIGS. 4 and 5 are pivoted in an extension direction, thereby inhibiting pivotal movement of the cam lever 80 and hence preventing opening/closing of the gripper units 28. Printing is then initiated. The sheet 30 printed with a first color in the same manner as in double side printing described with reference to FIG. 13 is gripped by the gripper units 19 (or 20). The leading edge of the sheet 30 reaches a position of contact between the cylinders 12 and 13. In this case, the opening/closing cam 43 cooperates with the torsion bar 95 to open and close the gripper units 25 and cause the units 25 to grip the sheet edge released from the gripper units 19 (or 20). When the gripped edge reaches a position of contact between the cylinders 13 and 10, the opening/closing cam 44 cooperates with the torsion bar 95 to open and close the gripper units 25 and cause the gripper units 9 to grip the sheet, thereby performing printing with a second color.

When single side printing is switched to double side printing, the phases of the cylinders 12 and 13, the phases between the suction heads 21 and 22 and the gripper units 19 and 20 according to a paper size, and the paper release positions of the gripper units 19 and 20 are adjusted. The stopper lever 111 is pivoted to allow the turn-over operation of the gripper units 25 and 28. At the same time, the stoppers 98 are moved backward to allow pivotal movement of the cam lever 80 and opening/closing of the gripper units 28. Thereafter, printing is initiated. As described with reference to FIG. 13, the trailing edge of the sheet 30 having an image on the upper surface reaches a point of contact between the cylinders 12 and 13. In this case, the opening/closing cam 40 cooperates with the torsion bar 83 to open and close the gripper units 28, and the trailing edge of the sheet 30 is released from the suction heads 21 (or 22) and gripped by the gripper units 28. Subsequently, the turn-over cam 39 cooperates with the torsion bar 63 and the turn-over cam 42 cooperates with the torsion bar 62 to cause the grippers of the gripper units 25 and 28 to come close each other. In this state, the gripper units 25 and 28 cooperate with the torsion bars 95 and 83 to open and close the gripper units 28 and 25 at slightly different timings. Therefore, the trailing edge of the sheet is gripped from the gripper units 28 to the gripper unit 25. When the turn-over cylinder 13 is further rotated, the gripper units 25 and 28 are moved in opposite directions and restore the initial positions. At the same time, the sheet is turned over and the gripper units 25 reaches a position of contact between the cylinders 13 and 10. In the same manner as in single side printing, the sheet is gripped by the gripper units 9. The sheet is conveyed by the gripper units 9 and an image is printed on the lower surface of the sheet.

Figure 10:
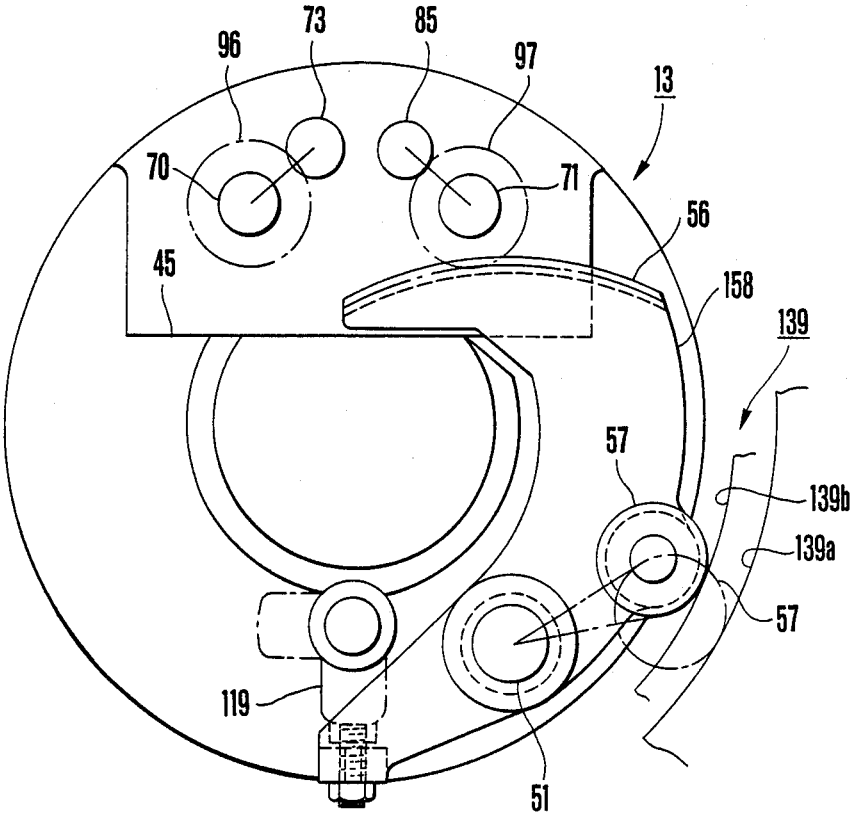
FIG. 10 is a sectional view showing the structure of a part near the cam levers in correspondence with FIG. 4 according to another embodiment of the present invention.
Figure 11:
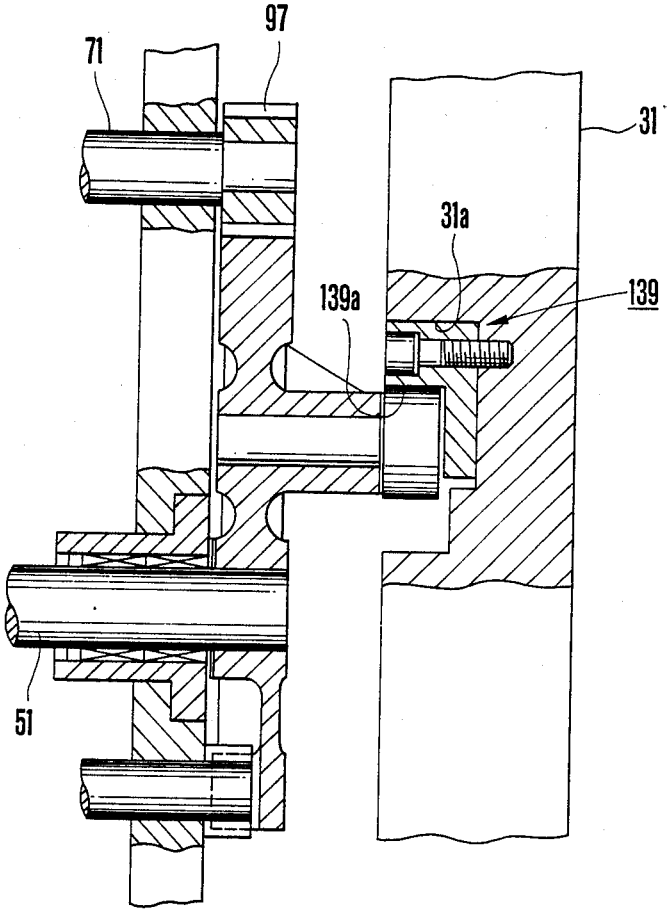
FIG. 11 is a longitudinal sectional view thereof.

FIGS. 10 and 11 show another embodiment of the present invention. In this embodiment, a turn-over cam 139 for gripper units A is bolted in an annular groove 31*a* formed in a frame 31 and includes a small-diameter portion 139*a* and a large-diameter portion 139*b*. The proximal portion of a cam follower 57 for a cam lever 158 is fixed at a portion near a segment gear 56 with respect to a cam lever shaft 51. Reference numeral 119 denotes a stopper for rendering the cam 139 operative or inoperative. When the stopper 119 is set in the upright or lying position, pivotal movement of the cam lever 158 is allowed or inhibited. Other structures and operations in this embodiment are the same as those of the above embodiment. A turn-over cam (not shown) for gripper units B and a cam lever (not shown) therefor are arranged on the side of a frame 32. Opening/closing cams (not shown) are arranged between the turn-over cams for gripper units A and B and the cam levers, and the construction and operation of the opening/closing cam are not described.

In a sheet turn-over apparatus for a sheet-fed rotary printing press according to the present invention as described above, the right cams comprise the turn-over cam for gripper units A and the opening/closing cams for gripper units B, while the left cams comprise the turn-over cam for gripper units B and the opening/closing cams for gripper units A. The cams cooperate with the corresponding torsion bars arranged at the pivotal centers of the cam levers to turn over and open/close the gripper units A and B. Unlike in the conventional gripper return spring, the rotational force, i.e., a load acting on the turn-over shaft of each gripper can be reduced. Durability of shafts and drive gears between the shafts and the cam levers can be greatly improved. Cutting of a chain does not occur since the chain is not used, thereby simplifying the construction. In addition, cams are fixed at predetermined positions of the frames and need not be shifted in the single side printing and double side printing. Therefore, the construction and operation can be simplified. At the same time, an excess load does not act on the cam followers and its durability can be improved. Furthermore, the gripper opening/-closing cams need not be shifted in the non-turn-over and turn-over modes and therefore the construction can be simplified. Identical components can be symmetrically arranged, and the number of different components can be greatly reduced, resulting in low cost.

What is claimed is:

1. A sheet turn-over apparatus for a sheet-fed rotary printing press including a turn-over cylinder provided with first gripper units for receiving a sheet from grippers of an upstream cylinder and gripping a trailing edge of the sheet and second gripper units for gripping the trailing edge of the sheet released and turned over from said first gripper units and causing grippers of a downstream cylinder to grip the trailing edge of the sheet, said first and second gripper units being adjacent to each other on an outer surface of said turn-over cylinder, comprising:

right and left frames;

a turn-over cam for said second gripper units, and first and second opening/closing cams for said first gripper units, all of which are fixed to one of said frames;

a turn-over cam for said first gripper units and third and fourth opening/closing cams for said second gripper units, all of which are fixed to the other frame;

first and second hollow cam lever shafts having different circumferential phases;

a first cam lever fixed to one end of said first hollow cam lever shaft and a second cam lever fixed to the other end of said second hollow cam lever shaft, said first cam lever being provided with a segment gear at one end thereof and a first cam follower at the other end thereof, said second cam lever being provided with a segment gear at one end thereof and a second cam follower at the other end thereof, said first cam follower being in contact with said turn-over cam for said second gripper units, and said second cam follower being in contact with said turn-over cam for said first gripper units;

a first gripper pad shaft for said first gripper units and a second gripper pad shaft for said second gripper units, said first and second gripper pad shafts extending in an axial direction of said turn-over cylinder;

a first gripper shaft for said first gripper units and a second gripper shaft for said second gripper units, said first and second gripper shafts being hollow, adjacent to said first and second gripper pad shafts, respectively, and extending along the axial direction of said turn-over cylinder;

a third cam lever fixed to one end of said first gripper pad shaft and a fourth cam lever fixed to the other end of said second gripper pad shaft, said third and fourth cam levers being provided with third and fourth cam followers, respectively, said third cam follower being in contact with said third and fourth opening/closing cams, and said fourth cam follower being in contact with said first and second opening/closing cams;

first to fourth torsion bars extending through said first and second cam lever shafts and said first and second gripper shafts, respectively, one end of each of said first to fourth torsion bars being fixed to a corresponding one of said first and second cam lever shafts and said first and second gripper shafts, said first and second torsion bars being coupled to said first and second cam levers at the other end and one end of said first and second cam lever shafts, respectively, and said third and fourth torsion bars being coupled to said third and fourth cam levers, respectively, said first and second cam lever shafts being coupled to said first and second gripper pad shafts and said first and second gripper shafts through a gear mechanism.

2. An apparatus according to claim 1, wherein said turn-over cam for said second gripper units includes a first ascending surface and a first descending surface, and said turn-over cam for said first gripper units includes a second ascending surface and a second descending surface, so that when said first and second cam followers descend along said first and second descending surfaces, said second gripper units are turned over clockwise and said first gripper units are turned over counterclockwise to obtain a turn-over state, and when said first and second cam followers ascend along said first and second ascending surfaces, said first and second gripper units restore an initial state.

3. An apparatus according to claim 2, wherein said second opening/closing cam includes an outer cam surface large-diameter portion, said first opening/closing cam includes a first inner cam surface large-diameter portion, and said fourth opening/closing cam includes a second inner cam surface large-diameter portion shorter than said first inner cam surface large-diameter portion, so that when said fourth cam follower runs over said outer cam surface large-diameter portion, said fourth cam follower cooperates with said fourth torsion bar to open and close said first gripper units so as to allow said grippers in said downstream cylinder to grip the trailing edge of the sheet in single side printing; and when said fourth and third cam followers cooperate with said fourth and third torsion bars to run over said first and second inner cam surface large-diameter portions, said third and fourth cam followers cooperate with said third and fourth torsion bars to open and close said second and first gripper units at slightly different timings so as to regrip the sheet from said second gripper units to said first gripper units.

4. An apparatus according to claim 3, further comprising a turn-over preventing mechanism including a stop lever mounted on said first and second gripper pad shafts, a stopper a stop pin, and a compression biasing spring, wherein said stop pin is pivoted to set said stopper in an upright position, pivotal movement of said stop lever is inhibited and said first and second cam followers are separated from said turn-over cams for said first and second gripper units through said first and second cam levers to prevent a turn-over operation in single side printing.

5. An apparatus according to claim 4, wherein said turn-over cam for said first gripper units is bolted in an inner groove formed in said right frame, said turn-over cam for said first gripper units being rendered operative/inoperative by said stopper.

* * * * *